United States Patent [19]

Liesener

[11] 4,379,389

[45] Apr. 12, 1983

[54] HORSEPOWER CONSUMPTION CONTROL FOR VARIABLE DISPLACEMENT PUMPS

[75] Inventor: Kenneth P. Liesener, Peoria, Ill.

[73] Assignee: Caterpillar Tractor Co., Peoria, Ill.

[21] Appl. No.: 261,098

[22] PCT Filed: Sep. 12, 1980

[86] PCT No.: PCT/US80/01194

§ 371 Date: Sep. 12, 1980

§ 102(e) Date: Sep. 12, 1980

[87] PCT Pub. No.: WO82/01046

PCT Pub. Date: Apr. 1, 1982

[51] Int. Cl.[3] ..... F16D 31/02

[52] U.S. Cl. ..... 60/428; 60/452; 417/216; 417/222

[58] Field of Search ..... 60/428, 426, 427, 445–452; 417/212, 216–222

[56] References Cited

U.S. PATENT DOCUMENTS

| | | | |
|---|---|---|---|
| 3,213,617 | 10/1965 | Hallberg . | |
| 3,732,036 | 5/1973 | Busbey et al. | 417/216 |
| 3,918,259 | 11/1975 | Habiger et al. | 60/445 |
| 3,941,514 | 3/1976 | Louis et al. | 417/216 |
| 3,998,053 | 12/1976 | Johnson | 60/422 |
| 3,999,892 | 12/1976 | Hein | 60/428 X |
| 4,080,979 | 3/1978 | Hein | 417/216 X |
| 4,116,587 | 9/1978 | Liesener | 60/445 X |

FOREIGN PATENT DOCUMENTS 1212625 11/1970 United Kingdom .

OTHER PUBLICATIONS

"Hydraulic Systems that Conserve Energy" by R. Henke, *Machine Design*, Aug. 12, 1976, pp. 81–85.

"Pump Controls that Save Energy" by H. Sculthorpe, *Machine Design*, Apr. 21, 1977, pp. 255–259.

*Primary Examiner*—Edward K. Look

*Attorney, Agent, or Firm*—Phillips, Moore, Lempio, Finley

[57] ABSTRACT

Flow-pressure compensated valves are employed in servo-systems for variable displacement pumps to maintain pump discharge pressure above a minimum pressure level and above the load pressure in a fluid actuator, during the working range of the pumps. In addition, such systems may also include a horsepower limiting valve for ensuring that the rating or predetermined range of horsepower consumption of the pumps is not exceeded. Prior art systems normally continually bleed-off pump discharge or load pressure signals when such horsepower requirements are exceeded to, thus, effect an undesirable horsepower loss in the system. In addition, control systems of this type normally cannot be packaged in modular form and are not adapted for use with pumps of various capacities and sizes. The improved fluid circuit (10) of this invention includes a horsepower limiting arrangement (39) for blocking communication of an actuator pressure signal ($P_A$) to an actuating chamber (37) of a servo-system (24) for a variable displacement pump (11) and to vent the actuating pressure signal ($P_A$) in response to a pressure control signal ($P_C$) which indicates that the pump (11) has exceeded its predetermined range of horsepower consumption.

6 Claims, 4 Drawing Figures

HORSEPOWER CONSUMPTION CONTROL FOR VARIABLE DISPLACEMENT PUMPS

DESCRIPTION

TECHNICAL FIELD

This invention relates generally to a fluid circuit having a horsepower limiting control for a variable displacement pump and more particularly to a fluid circuit including a "load-plus" valve for modulating an actuator pressure signal during a predetermined range of horsepower consumption of the pump and a horsepower limiting control for modulating the pressure signal in response to a pressure control signal, indicating that the pump has exceeded such horsepower range.

BACKGROUND ART

It is well-known in the arts relating hereto to employ a flow-pressure compensated or "load-plus" valve to maintain the discharge pressure of a variable displacement pump above a minimum pressure level and also above a load pressure generated in a fluid actuator, during a working range of the pump. This type of valve is fully disclosed in U.S. Pat. No. 4,116,587, issued on Sept. 26, 1978 to Kenneth P. Liesener, and assigned to the assignee of this application. The valve functions to sense a load pressure signal and to automatically communicate and modulate an actuator pressure signal for controlling the position of a swash plate of the pump to maintain the pump at its desired displacement.

Should the rating or working horsepower consumption range of the pump be exceeded, it is further desirable to modify the actuator pressure signal to destroke the pump to prevent potential damage thereto and to related components of the fluid circuit. U.S. Pat. No. 3,999,892, issued on Dec. 28, 1976 to Allyn J. Hein, and also assigned to the assignee of this application, discloses a pump control system wherein the actuator pressure signal is vented to tank when such horsepower consumption range is exceeded. This periodic bleeding-off of the actuator pressure signal results in an undesirable loss of system horsepower. Furthermore, the integrated fluid circuit does not adapt the horsepower limiting feature to be incorporated into a module adapted for use with pumps of various sizes.

The present invention is directed to overcoming one or more of the problems as set forth above.

DISCLOSURE OF INVENTION

In one aspect of the present invention, a fluid circuit comprises a fluid motor, a variable displacement pump having a control member movable between first and second displacement positions, first biasing means for urging the control member towards its first displacement position, second biasing means for urging the control member towards its second displacement position in response to an actuator pressure signal communicated to it from the pump, and modulating means for modulating the actuator pressure signal in response to variations in a load pressure signal communicated thereto from the fluid motor and during a predetermined working range of horsepower consumption of the pump. The improved fluid circuit further comprises means for blocking communication of the actuator pressure signal with the second biasing means and for venting the actuator pressure signal in response to a pressure control signal indicating that the pump has exceeded its predetermined range of horsepower consumption.

The improved fluid circuit will thus ensure maximum performance efficiency of the prime mover for the pump by preventing undesirable venting of the actuator pressure signal when the rating of the pump has been exceeded. The above improvement also has the advantage of being adapted to pumps of various sizes in modular form.

BRIEF DESCRIPTION OF THE DRAWINGS

Other objects and advantages of this invention will become apparent from the following description and accompanying drawings wherein.

BEST MODE OF CARRYING OUT THE INVENTION

GENERAL DESCRIPTION

Figure 1:
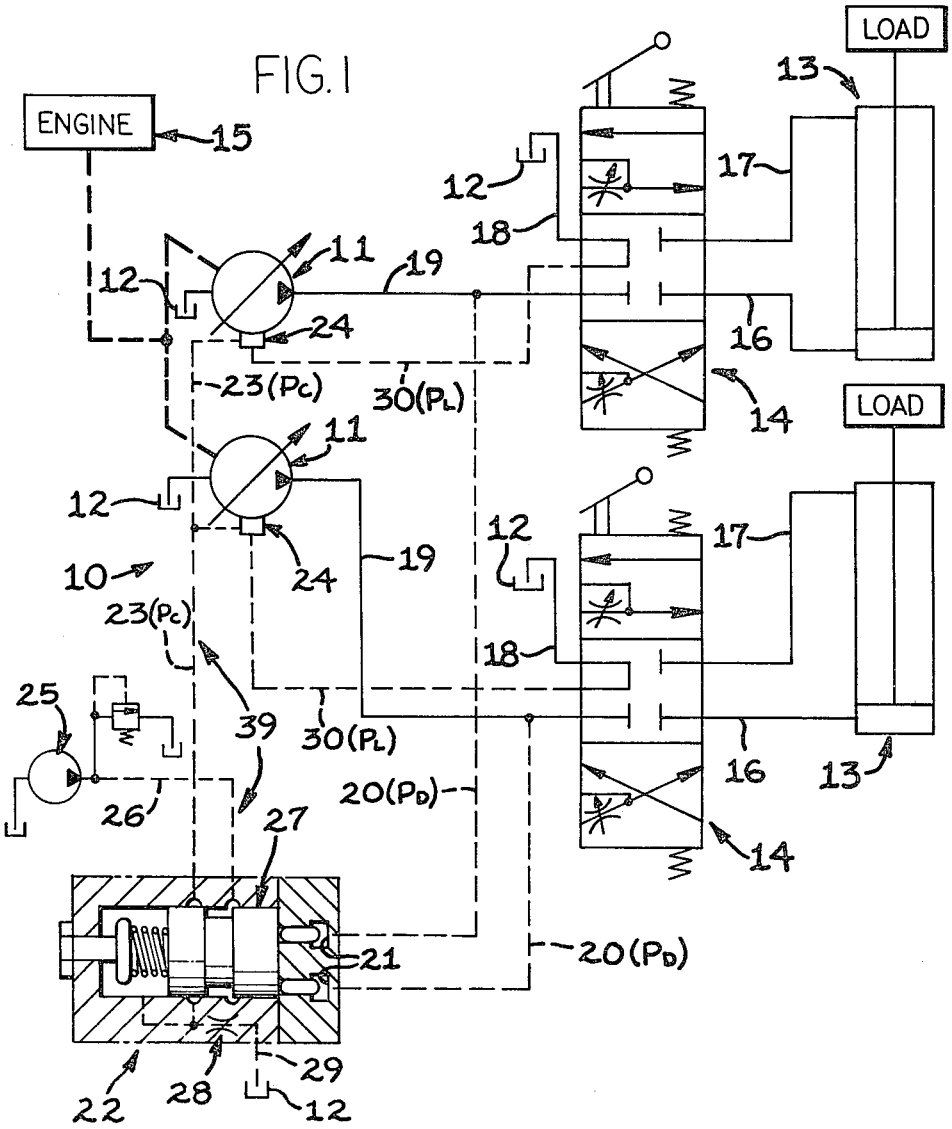
FIG. 1 schematically illustrates a fluid circuit, having a pair of variable displacement pumps each associated with a fluid motor, incorporating a horsepower limiting control system embodiment of the present invention therein for preventing each of the pumps from exceeding its rating.

FIG. 1 illustrates a fluid circuit 10 comprising a pair of variable displacement pumps 11, each adapted to communicate pressurized fluid from a source 12 to a fluid motor 13 under the control of a directional control valve 14. A prime mover 15, such as an internal combustion engine, is adapted to drive pumps 11, with each pump preferably taking the form of a hydraulic pump of the type illustrated in FIG. 2. Each fluid motor 13 may take the form of a double-acting hydraulic cylinder, for example, adapted for use on a construction vehicle or the like in a conventional manner.

Upon selective actuation of a respective directional control valve 14, head and rod ends of a connected cylinder 13 may be alternately pressurized and exhausted in a conventional manner via lines 16 and 17 and lines 18 and 19. Upon pressurization of one of the ends of a selected cylinder 13, a line 20 will communicate a pump discharge pressure $P_D$ to an actuating chamber 21 of a summing valve 22. As described more fully hereinafter, summing valve 22 provides a summing means for creating a control pressure signal $P_C$ in a line 23 in response to collective pump discharge pressures $P_D$, reflecting the averaged discharge pressures of pumps 11, to control the actuation of servo-systems 24 employed for pumps 11.

Control pressure signal $P_C$ is created by another engine-driven pump 25 which is connected to summing valve 22 by a line 26. As illustrated in FIG. 1, when the averaged pump discharge pressures $P_D$, in part reflecting the horsepower consumption of the pumps, exceeds a predetermined level in chambers 21, a spring-biased spool 27 of summing valve 22 will shift leftwardly to throttle and meter fluid pressure in a controlled and modulated manner from line 26 to line 23 to create control pressure signal $P_C$ in the latter line. The magnitude or response of control pressure signal $P_C$ is closely controlled by a restricted orifice 28 and a drain line 29, connected to fluid source or tank 12. A line 30 is interconnected between each directional control valve 14 and a respective servo-system 24 for communicating load pressure signal $P_L$ to the servo-system upon pressurization of the head or rod end of a respective cylinder 13.

Figure 2:
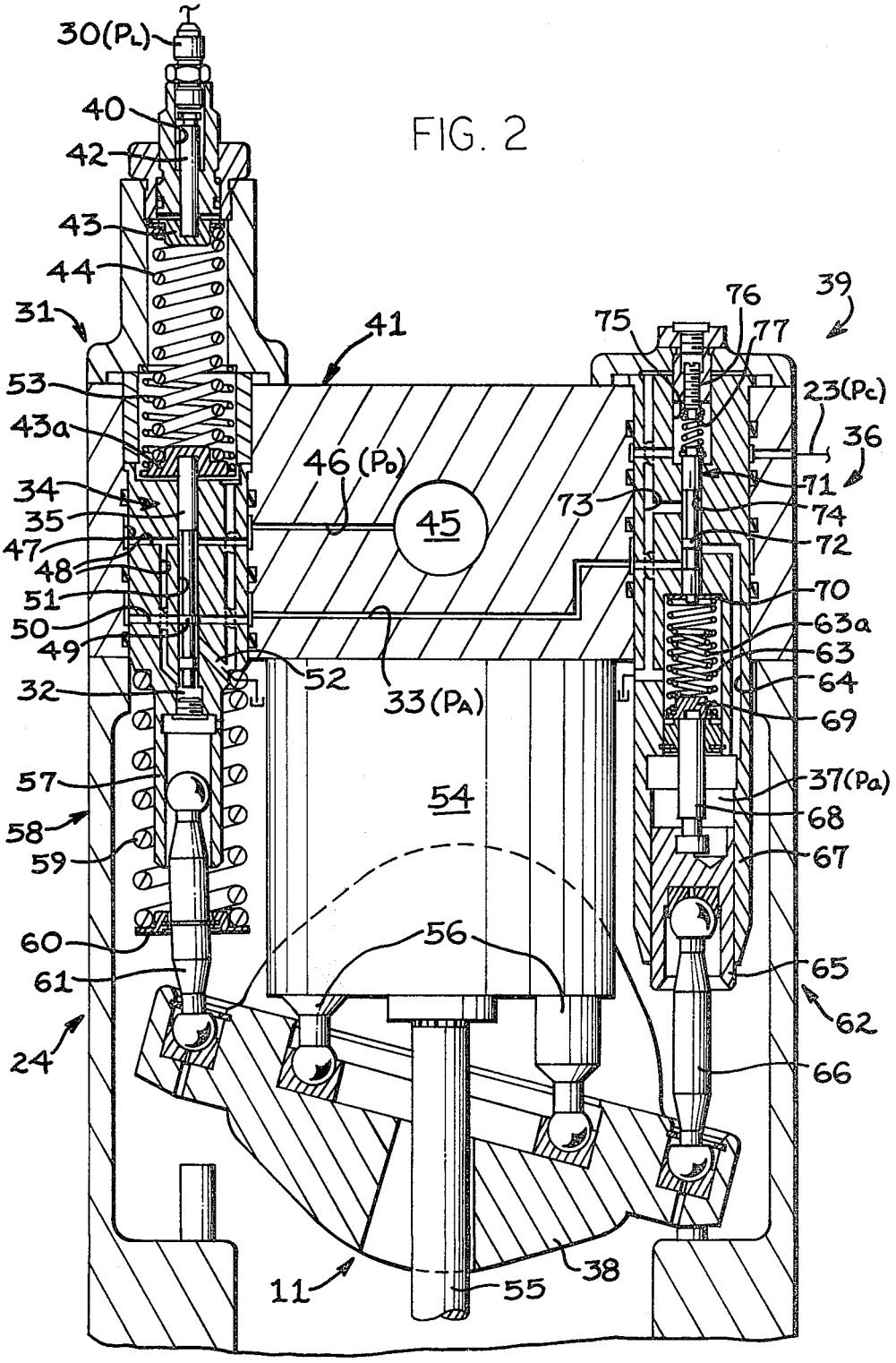
FIG. 2 is a longitudinal sectional view through one of the pumps and the control system therefor.

Referring to FIG. 2, and as described more fully hereinafter, load pressure signal $P_L$ is communicated to one side of a flow-pressure compensated or "load-plus" valve 31, whereas pump discharge pressure $P_D$ is communicated to a chamber 32 on the opposite end of the valve to create and modulate an actuator pressure signal $P_A$ in a passage 33. Valve 31 includes a modulating means 34, having a modulating spool 35, for modulating actuator pressure signal $P_A$ in response to variations in load pressure signal $P_L$ and during a predetermined working range of horsepower consumption of pump 11. During such range of horsepower consumption and during normal operation of the fluid circuit, actuator pressure signal $P_A$ will communicate through a horsepower limiting valve 36 and to an actuating chamber 37 for controlling the position of a control member of swash plate 38 of pump 11 and thus, the displacement of the pump. This invention is generally directed to a horsepower limiting means 39 (FIG. 1), including horsepower limiting valve 36, which functions to block communication of actuator pressure signal $P_A$ from passage 33 to actuating chamber 37 and to vent the actuating chamber when pressure control signal $P_C$ in line 23 indicates that pump 11 has exceeded the above-mentioned predetermined working range of horsepower consumption. It should be particularly noted from the following description that the blocking of passage 33 and substantially simultaneous venting of actuating chamber 37 will result in a minimum fluid loss in the working system (the maximum loss being equated to the maximum volume of hydraulic fluid or oil contained in actuating chamber 37) to thus, minimize horsepower losses in the system. In addition, it will be seen that horsepower limiting means 39 may be fabricated as a modular unit adapted for attachment to and use with pumps of various sizes.

DETAILED DESCRIPTION

FIG. 2 EMBODIMENT

Referring once again to FIG. 2, line 30 communicates load pressure $P_L$ to a chamber 40, defined in a housing 41 above a piston 42. A lower end of the piston is secured in a retainer 43 and a compression coil spring 44 is disposed between retainer 43 and a second retainer **43*a*. Retainer 43*a* is secured on an upper end of modulating spool 35, whereby the force created by load pressure signal $P_L$ in chamber 40 will act through spring 44 and against the opposed force of pump discharge pressure $P_D$ in chamber 32**.

Pump discharge pressure is communicated to chamber 32 from a discharge outlet 45 of pump 11 via a passage 46, an annulus 47, and passage 48. In the illustrated modulating position of spool 35, a land 49 thereof is shown straddling a passage 50. Downward shifting of the spool will communicate pump discharge pressure $P_D$ from passage 46 to passage 33, via annulus 47, passage 48, an annular passage 51 defined about modulating spool 35, and passage 50. Conversely, upward shifting of the spool from its straddling position will communicate passage 33 with a drain passage 52, via passage 50.

During normal operation of fluid circuit 10 and with the horsepower consumption of each pump 11 being maintained within a predetermined working range and below their ratings, land 49 of modulating spool 35 will straddle passage 50 and modulate between the above two positions to maintain the desired fluid pressure level of actuator pressure signal $P_A$ in actuating chamber 37 in response to the pressure differential occasioned between load pressure signal $P_L$ in chamber 40 and pump discharge pressure $P_D$ in chamber 32. It should be noted that spring 44 and a concentrically disposed compression coil spring 53, further disposed between housing 41 and retainer **43*a***, function to maintain pump discharge pressure $P_D$ at a standby and "MARGIN" pressure above load pressure $P_L$ during the working range of the fluid circuit. This arrangement and functions are more extensively described in above-referenced U.S. Pat. No. 4,116,587.

As shown in FIG. 2, pump 11 further comprises a barrel 54 which is adapted to be driven by an output shaft 55 of engine 15 (FIG. 1), and a plurality of reciprocal pistons 56 connected to swash plate 38. The displacement of pump 11 is determined by the rotational orientation of swash plate 38 which has one side thereof connected within a tubular member 57, secured in housing 41, by a first biasing means 58. The first biasing means includes a compression coil spring 59 mounted between member 57 and a retainer 60 attached on a rod 61.

One end of rod 61 is pivotally mounted on swash plate 38, whereas the opposite end thereof is reciprocally mounted within member 57. First biasing means 58 functions to urge swash plate 38 towards a first or minimum displacement position and against the opposed biasing force of a second biasing means 62. Second biasing means 62, including the force generated by actuator pressure signal $P_A$ in actuating chamber 37 and a compression coil spring 63, functions to urge swash plate 38 towards its illustrated second or maximum displacement position. In the illustrated position of swash plate 38, it can be assumed that the combined forces of spring 63 and the pressurized fluid in actuating chamber 37 are sufficient to overcome the lesser, opposing force of spring 59.

During the working range of fluid circuit 10 wherein the horsepower consumption of pumps 11 is maintained below a maximum level, horsepower limiting valve 36 will remain in its open position illustrated in FIG. 2. "Load-Plus" valve 31 will thus continuously modulate actuator pressure signal $P_A$ in chamber 37 via passage 33 and a connecting passage 64, through valve 36. Venting of chamber 37 through valve 31 and into drain passage 52 upon upward shifting of modulating spool 35 will permit spring 59 of first biasing means 58 to overcome the opposing force of second biasing means 62 to pivot swash plate 38 counterclockwise in FIG. 2. Thus, an actuator or piston 65, pivotally connected to swash plate 38 by a rod 66, will move upwardly in a tubular member 67, forming a part of housing 41 and defining chamber 37 therein. A follow-up link or rod 68 is attached to piston 65 for simultaneous movement therewith and a retainer 69 is secured on an upper end of the link to seat a lower end of spring 63 thereon. An annular washer 70 is mounted on an upper end of spring 63 and a second spring **63*a* is mounted concentrically within spring 63** and has a shorter length for purposes hereinafter explained.

As described above, horsepower limiting valve 36 will remain in its illustrated open position to communicate actuator pressure signal $P_A$ from passage 33 to passage 64 during the normal working range of fluid circuit 10. However, when pressure control signal $P_C$ exceeds a predetermined maximum level, a spool 71 of valve 36 will shift downwardly to move a land 72 thereof in a blocking position preventing communication of passage 33 with passage 64. Substantially simultaneously therewith, passage 64 will communicate pressurized fluid from actuating chamber 37 to a drain passage 73, via an annular passage 74 defined about spool 71. It should be noted that a lower end of spool 71 is secured to washer 70 which, with the aid of spring 63 and with a chamber 75 above spool 71 being depressurized, will precisely position land 72 to open communication of passage 33 with passage 64. It should be further noted that the force imposed on the upper end of spool 71 may be adjusted mechanically by a set screw 76 and a compression coil spring 77, mounted between the upper end of spool 71 and the set screw.

FIG. 3 EMBODIMENT

Figure 3:
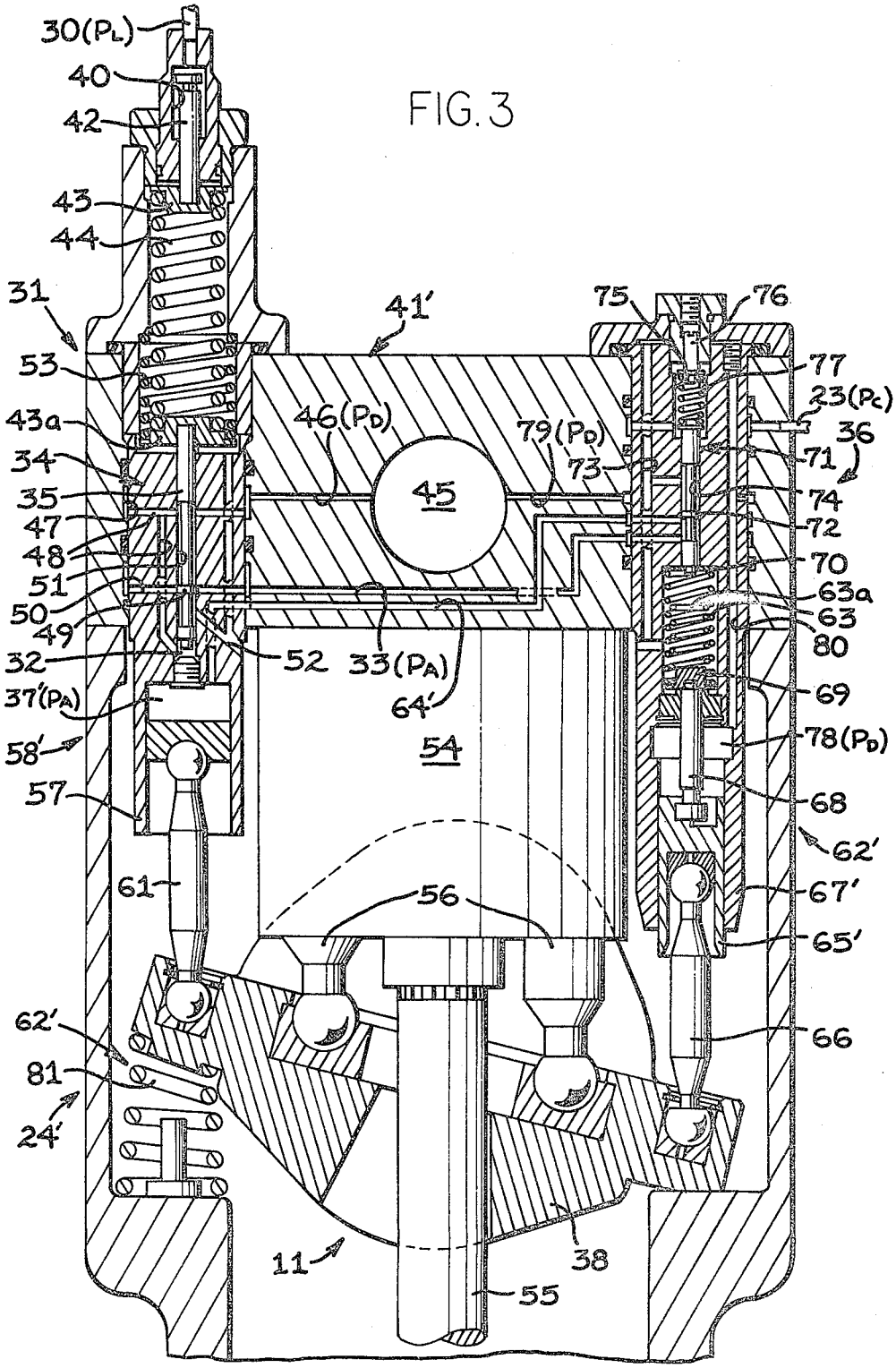
FIG. 3 is a view similar to FIG. 2, but illustrates a modification of the control system.

FIG. 3 illustrates a modified servo-system 24' wherein corresponding constructions are depicted by identical numerals, but wherein numerals depicting modified constructions are accompanied by a prime symbol (′). Servo-system 24' essentially differs from servo-system 24 (FIG. 2) in that actuator pressure signal $P_A$ in a chamber 37' comprises a first biasing means 58' for biasing swash plate 38 of pump 11 towards its first or minimum displacement position against the opposed biasing force of a modified second biasing means 62'. Second biasing means 62' comprises spring 63, a chamber 78 arranged to have pump discharge pressure $P_D$ communicated therein via passages 79 and 80, and a compression coil spring 81 mounted between a modified housing 41' and swash plate 38.

The operation of "load-plus" valve 31 is substantially identical to that described above in that pump discharge pressure $P_D$ will be communicated to chamber 32, whereby the force thereof will be counteracted by load pressure signal $P_L$ communicated to chamber 40 by line 30 to control the position of modulating spool 35. During such modulation and when modulating spool 35 is shifted downwardly from its position shown in FIG. 3, pump discharge pressure will be communicated to passage 33 via passage 46, annulus 47, passage 51, and past land 49 of the modulating spool. During normal operation of the system and during the working range thereof, actuator pressure signal $P_A$ will be communicated from passage 33, through horsepower limiting valve 36 (past land 72 thereof), through a passage 64', and into actuating chamber 37' to control the displacement of pump 11 in the manner described above.

When the averaged pump discharge pressures $P_D$ exceed a predetermined level, summing valve 22 (FIG. 1) will be actuated to communicate modulated control pressure signal $P_C$ to horsepower limiting valve 36, via line 23. As a result, spool 71 of the horsepower limiting valve will shift downwardly in FIG. 3 to block the open connection between passages 33 and 64' and to vent actuating chamber 37' via passage 64' and drain passage 73. The remaining functions of servo-system 24' are substantially identical to those described above in respect to the operation of servo-system 24.

Industrial Applicability

Fluid circuit 10 of FIG. 1 finds particular application to hydraulic circuits for construction vehicles and the like wherein close and efficient control of fluid motors or cylinders 13 thereof is required. In this respect, the fluid circuit utilizes pressure compensation in conjunction with a displacement follower which, through actuator pressure signal $P_A$ and control pressure signal $P_C$, will change the null point pressure along a constant horsepower envelope. Fluid circuit 10 will provide for instant and correct sensing and response to system energy consumption on demand, over a wide pressure range. Another advantage of the fluid circuit is that the venting of actuating chamber 37 and 37' results in minimum fluid loss to conserve horsepower losses, when the horsepower consumption of one or both of the pumps exceeds a predetermined maximum level. In addition, horsepower limiting means 39, including horsepower limiting valve 36, may be tailored into a relatively small module adapted for attachment to pumps of various sizes and capacities.

Referring to FIGS. 1 and 2, "load-plus" valve 31 will function as a conventional pressure-compensated flow control valve operating in a normal manner throughout the working range of its associated pump 11 to provide a load-sensitive control of pump discharge pressure $P_D$ in line 19, relative to load pressure signal $P_L$, and will continuously provide a margin between these pressures, as described in above-referenced U.S. Pat. No. 4,116,587. Summing valve 22 is arranged to receive pump discharge pressures $P_D$ via lines 20 to create and modulate control pressure signal $P_C$ in line 23 for controlling the displacement of the pumps. In particular, when the summed pump discharge pressures $P_D$ are equal to or less than a predetermined pressure level, spool 27 will remain in its closed position illustrated in FIG. 1 to prevent communication of pressurized fluid from pump 25 to line 23. Thus, control chamber 75 (FIG. 2) will remain vented via drain line 29 to prevent any downward shifting of spool 71 against the opposed biasing force of spring 63. Thus, so long as pumps 11 are operating in their normal range of working pressures, fluid circuit 10 will remain under full control of "load-plus" valves 31, associated with pumps 11, as described above.

Under operating conditions in which pumps 11 are consuming all of the available horsepower from engine 15, the summed pump discharge pressures $P_D$ in lines 20, also reflecting the load pressures in the cylinders, will exceed a predetermined level to shift spool 27 of summing valve 22 leftwardly in FIG. 1 to communicate pump 25 with line 23. Throttled and modulated control pressure signal $P_C$ will thus communicate with chamber 75 (FIG. 2) to shift spool 71 downwardly against the opposed modulating force of spring 63 to at least partially open passage 64 and actuating chamber 37 to drain passage 73 to vent a controlled amount of actuator pressure signal $P_A$. The resultant reduction in fluid pressure in chamber 37 will thus permit swash plate 38 to pivot counterclockwise in FIG. 2 towards its minimum displacement position. This motion of the swash plate will feed back to spool 71 of horsepower limiting valve 36, via rod 66, piston 65, rod 68, and spring 63 to move the spool upwardly to again communicate passages 33 and 64.

As the reduction in pump displacement reduces the horsepower consumption from the engine, spool 27 of summing valve 22 will maintain a position therein respective of the system pressure to modulate control pressure signal $P_C$ in line 23. Pumps 11 will continue to operate at their restaged displacement settings until such time as the summed pump discharge pressures $P_D$ exceed a level whereby the horsepower consumption exceeds that available from the engine. Upon attaining this condition of operation, control pressure signal $P_C$ will be increased in control chamber 75 and horsepower limiting valve 36 will again function in the manner described above to further reduce pump displacement and, thus, closely control the total horsepower consumption from engine 15. Conversely, reduction in the summed pump discharge pressures $P_D$ will permit the displacement of pumps 11 to increase by permitting the swash plates thereof to move back towards their maximum displacement position, illustrated in FIG. 2.

Figure 4:
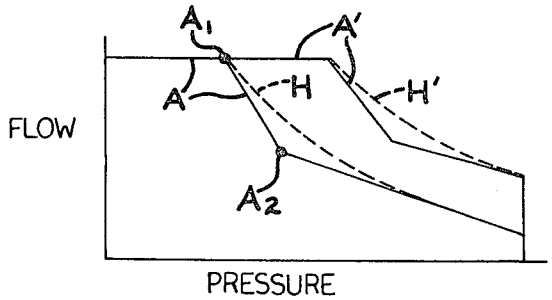
FIG. 4 graphically illustrates curves A and A', plotting pump flow versus load pressure, and a horsepower curve H.

It should be further noted in FIG. 2 that dual spring arrangement 63, 63*a* will provide that horsepower consumption curve A (FIG. 4) will closely match that of the engine horsepower curve H. In particular, curve A depicts a flow-pressure relationship upon opening of both directional control valves 14 to actuate cylinders 13 simultaneously and wherein the flat portion of the curve represents a flow-pressure utilization which is less than the total horsepower available from the engine. As such flow-pressure combination reaches a point $A_1$, which is roughly equal to the horsepower available from the engine, the pressure control signal $P_C$ from line 23 to chamber 75 acts upon modulating spool 71 and overcomes the opposed biasing force of spring 63. This will cause a reduction in the displacement or flow output of the pumps corresponding to the portion of the curve between points $A_1$ and $A_2$.

At point $A_2$, the upper end of spring 63*a* will contact washer 70 and thus becomes effective to modify the pressure-flow relationship illustrated by the remaining portion of curve A after point $A_2$. Thus, the combined actions or springs 63 and 63*a*, working against control pressure signal $P_C$ in chamber 75 of horsepower limiting valve 36, will provide a horsepower utilization which closely matches engine horsepower curve H. It should be understood that additional springs could be suitably staged in combination with springs 63 and 63*a* to even more closely match horsepower curve H. Portion A' of the curve depicts the function of the system when only a single pump 11 is connected to a respective cylinder 13 in response to opening of the associated directional control valve 14.

As discussed above, modified servo-system 24' of FIG. 3 will function substantially identically to servo-system 24, except that swash plate 38 is normally biased towards its maximum displacement position. During the latter condition of operation, the engine horsepower curve would shift to position H' in FIG. 4.

Other aspects, objects, and advantages of this invention can be obtained from a study of the drawings, the disclosure, and the appended claims.

I claim:

1. In a fluid circuit (10) having at least one fluid motor (13), a variable displacement pump (11) having a discharge pressure ($P_D$), connected to said motor (13), a control member (38) movable between first and second displacement positions, first biasing means (58) for urging said control member (38) towards its first displacement position, second biasing means (62) for urging said control member (38) towards its second displacement position in response to an actuator pressure signal ($P_A$) communicated thereto from said pump (11), and means (34) for modulating said actuator pressure signal ($P_A$) in response to variations in a load pressure signal ($P_L$) communicated thereto from said fluid motor (13) during a predetermined range of horsepower consumption of said pump (11), the improvement comprising:

means (25) for generating a pressure control signal ($P_C$) and horsepower limiting means (39) for blocking communication of said actuator pressure signal ($P_A$) with said second biasing means (62) and for venting said actuator pressure signal ($P_A$) from said second biasing means (62) in response to said pressure control signal ($P_C$) which is responsive to said pump discharge pressure ($P_D$).

2. The fluid circuit (10) of claim 1 wherein a plurality of said fluid motors (13) are each connected to a said variable displacement pump (11) and further including summing means (22) for modulating said pressure control signal ($P_C$) in response to the average fluid discharge pressures ($P_D$) of said pumps.

3. The fluid circuit (10) of claim 1 wherein said modulating means (34) includes a modulating spool (35) having said fluid discharge pressure ($P_D$) and said load pressure signal ($P_L$) act in opposition on opposite ends thereof.

4. The fluid circuit (10) of claim 3 wherein said horsepower limiting means (39) includes a horsepower limiting valve (36) having spool means (71) movable between a first position at which said actuator pressure signal ($P_A$) from said modulating means (34) is in fluid communication with said second biasing means (62) at said predetermined range of horsepower consumption of said pump (11) and a second position at which said actuator pressure signal ($P_A$) is vented from said second biasing means (62) in response to said pressure control signal ($P_C$).

5. The fluid circuit (10) of claim 1 further including means (63,63*a*) for modifying the flow-pressure requirements of said circuit as illustrated by curve A in FIG. 4 to generally conform to horsepower curve H, representing said horsepower consumption of said pump (11).

6. A fluid circuit (10) having a plurality of fluid motors (13), a variable displacement pump (11) having a discharge pressure ($P_D$), connected to each of said motors (13) and including a control member (38) movable between first and second displacement positions, first biasing means (58) for urging said control member (38) towards its first displacement position, second biasing means (62) for urging said control member (38) towards its second displacement position in response to an actuator pressure signal ($P_A$) communicated thereto from said pump (11), and means (34) for modulating said actuator pressure signal ($P_A$) in response to variations in a load pressure signal ($P_L$) communicated thereto from a respective one of said fluid motors (13) during a predetermined range of horsepower consumption of said pump (11), horsepower limiting means (39) for blocking communication of said actuator pressure signal ($P_A$) with said second biasing means (62) and for venting said actuator pressure signal ($P_A$) from said second biasing means (62) in response to a pressure control signal ($P_C$) which is responsive to said pump discharge pressure ($P_D$) indicating that said pump (11) has exceeded said predetermined range of horsepower consumption and summing means (22) for modulating said pressure control signal ($P_C$) in response to the average fluid discharge pressures ($P_D$) of said pumps (11).

* * * * *